US005199198A

United States Patent [19]

Godbout

[11] Patent Number: 5,199,198

[45] Date of Patent: Apr. 6, 1993

[54] APPARATUS AND METHOD FOR SNOW DISPOSAL

[76] Inventor: Pierre Godbout, c/o 211, boul. Saint Joseph Ouest, Montreal, Quebec, Canada

[21] Appl. No.: 827,644

[22] Filed: Jan. 29, 1992

[30] Foreign Application Priority Data

Jan. 30, 1991 [CA] Canada ..... 2035322

[51] Int. Cl.[5] ..... E01H 5/00

[52] U.S. Cl. ..... 37/196; 37/227; 405/36; 241/DIG. 17; 165/45; 126/343.5 R

[58] Field of Search ..... 405/36, 52, 61, 130, 405/131, 258; 241/DIG. 17; 165/45; 37/227, 228, 229, 196; 126/343.5 R

[56] References Cited

U.S. PATENT DOCUMENTS

| | | | |
|---|---|---|---|
| 642,314 | 1/1900 | Finigan | 37/227 X |
| 770,169 | 9/1904 | Davis | 37/227 X |
| 942,337 | 12/1909 | Moore | 37/227 X |
| 1,150,946 | 8/1915 | Kenlon | 126/343.5 R |
| 1,388,027 | 8/1921 | Connolly | 37/227 X |
| 1,468,977 | 9/1923 | Schiesari | 37/228 X |
| 1,665,503 | 4/1928 | McClave et al. | 126/343.5 R |
| 2,320,723 | 6/1943 | Gaylord . | |
| 2,684,209 | 7/1954 | Gangemi | 241/DIG. 17 X |
| 3,349,506 | 10/1967 | Rubin . | |
| 3,583,084 | 6/1971 | Farrell . | |
| 4,100,687 | 7/1978 | Jeswine . | |

FOREIGN PATENT DOCUMENTS

| | | | |
|---|---|---|---|
| 1081267 | 3/1984 | U.S.S.R. | 37/228 |
| 1323632 | 7/1987 | U.S.S.R. | 37/227 |

*Primary Examiner*—Randolph A. Reese
*Assistant Examiner*—Arlen L. Olsen
*Attorney, Agent, or Firm*—McFadden, Fincham, Marcus & Anissimoff

[57] ABSTRACT

There is disclosed a method and apparatus for disposal of snow in urban areas. Snow is disposed of using existing manhole or other connections to sewer systems with a portable or mobile disposal unit formed of a snow receiving bin, a grinding device, apparatus for projecting the ground snow in a controlled and linear confined manner and into a trajectory downwardly into the sewer and preferably with sensing apparatus to sense whether there is a blocked sewer conduit as well as to determine the load carrying capacity of the sewer liquid. In this way, the grinding device may be driven by variable speed motors. The system and method permit the use of already existing sewer systems, and is more economical than trucking snow to disposal sites. The system and method also permit the ready disposal of snow in areas where there are no disposal sites or where disposal sites are not allowed.

19 Claims, 5 Drawing Sheets

APPARATUS AND METHOD FOR SNOW DISPOSAL

BACKGROUND OF THE INVENTION

This invention relates to a snow disposal or flow control manipulation system and a method therefor.

In cities and towns where snow is ploughed from the streets or similar areas, and subsequently collected for disposal, it is generally the norm that the snow is collected by a snow blower or loader and placed into trucks, which then transport the collected snow to land sites where it is dumped and permitted to melt during warmer weather.

Snow removal has become a very expensive and time consuming affair. In general, the collection and disposal of snow can run into the millions of dollars each year even for smaller cities and towns. To a large extent, the cost of snow disposal relates to the cartage of snow from the area to the areas where it is to be stored or dumped. In modern cities, since there is very little area for the snow to be dumped or other sites for disposal, it must be transported significant distances to find disposal sites.

In the past, other alternatives have been considered such as dumping of the snow at closer locations where there may be a lake or stream. However, it is not as environmentally desirable to do this since snow gathered from streets or other areas is frequently polluted and generate ecological shock.

On the other hand, most cities have an underground sewage system and as such, the underground conduits, normally carry important volumes of warm water or liquid, which may then be treated at sewage treatment plants. Again, most cities have a relatively large number of conduits extending throughout the city infrastructure but such conduits, which connect the city streets via manhole covers, are generally only small diameter conduits e.g. two to four feet or so. Up until now, it has basically been impossible to be able to use the common type of manholes and associated conduits since no means has existed for loading or discharging snow from cartage vehicles into the sewer systems without clogging the manhole and with proper flow control so it does not arrive at the sewage treatment plant in a non-melted state.

Other proposals for disposing of snow have also included devices for melting snow into the sewer system. In general, cartage trucks will take a load of snow to a central point and dump the load into large heated bins, which melt the snow using an energy source such as electrical or fuel fired burners. Such a procedure is quite costly in terms of energy consumption and is not economically advantageous.

It would therefore be desirable if the conventional sewer system could be employed to dispose of snow, thus reducing the cartage distances and at the same time, eliminating snow build up in vacant land sites or dumping in natural water reservoirs where it may be illegal to do so.

SUMMARY OF THE INVENTION

According to this invention, and in one aspect thereof, there is provided a snow disposal or flow control system comprising: snow receiving means adapted to receive a charge of snow to be disposed of; first grinding means for grinding the charge of snow into a generally particulate form and for advancing the same in a disposal direction; means for effecting a projection of snow discharged by the first grinding means in a path removed from the first grinding means; disposal means for receiving projected snow from the last mentioned means located downstream in a direction in which the snow is projected by the last mentioned means, the disposal means including a conduit having a liquid flow adapted to receive and transport the disposed product away from the disposal site.

In preferred embodiments of the present invention, the disposal system includes receiving means adapted to receive, e.g. truck loads of snow from area or street cleaning operations. To this end, the receiving means may be a bin-like structure in which the upper portion is dimensioned so as to receive a load of snow which may be discharged from one or more dump trucks by backing up the truck and emptying the snow into the bin, or in other cases, the load of snow may be pushed by e.g. a bulldozer into the bin. The bin will have a narrower discharge end, dimensioned preferably in close proximation to the size of a manhole opening connecting with a sewer system conduit. Thus, the walls of the bin may be tapered to a narrower throat section.

To prevent snow from adhering to the bin, the material from which the bin is constructed of, e.g. sheet metal, plastic, concrete, wood, etc., may be provided with a coating of a suitable slippery substance such as a silicon polymer, a "Teflon" polymer, etc. Alternately, where the bin is made of e.g. metal or concrete, the bin may be heated to prevent snow adherence or buildup thereon. In a still further embodiment, where using wood, metal or like bins, vibrating means may be employed for the same purpose.

In a particularly preferred embodiment, the grinding means may include suitable means for advancing a charge of snow from a first position to a second position; typically this can include a grinding function and suitable devices for achieving this include grinding means such as at least a pair of rollers having counter rotating blades and means for driving the counter rotating blades. In addition, other equivalent means can be used to achieve the same effect and even advancing means such as piston arrangements may be employed. It is preferred that the bin like structure is generally vertically oriented relative to the grinding means and the grinding means is located beneath the bin.

Suitable grinding means may be e.g. one or more pairs of counter rotating blades, two or more rotating augers, or the like. It will be understood by those skilled in the art that any suitable grinding means may be employed.

In this respect, the grinding means need not necessarily be located within the bin like structure but rather, can be disposed exteriorly thereof beneath the discharge opening of the bin like structure.

In another preferred aspect, the means for effecting the projection of snow can be disposed in different aligned relationships relative to the grinding means such as being displaced from one trajectory beneath the grinding means or to one side of the same in a suitable flow path. The means for effecting the projection of snow is adapted to project ground up snow from the grinding means in a generally vertical trajectory into a conduit of the sewer system which has liquid therein. Typically, such means may be in the form of an impeller or like assembly which receives the snow and by means of one or more high speed blades, the snow is projected with an impelled velocity downwardly into the conduit and sewer system.

The impeller means may have separate drive means associated with it, relative to the drive means for the grinding component. If desired, however, similar drive means which drive the grinding means may be geared to the impeller means for this purpose.

In a particularly preferred embodiment of the present invention, the system includes sewer water characteristic sensing means which controls the speed of the process by for example controlling the speed of the motors for the grinding means. To this end, for example, the grinding means are preferably driven by variable speed motors; alternately, constant speed motors may be employed using variable speed mechanical gear or gear reducing means to control the speed of the motor. In turn, the variable speed motors, or constant speed motors with variable speed gears and the like, can be controlled by control means responsive to sensing means. The sensing means preferably sense the absorption capacity of the liquid into which the snow is absorbed; thus, sensing means for measuring heat load of the liquid can be employed. While such sensing means may take various forms preferably a sensing means which senses the temperature and flow of the sewer water upstream and downstream is employed for this purpose.

In addition, sensing means are also preferably employed to sense any blockage in the trajectory path of the snow. Such sensing means can be electronic to determine whether snow forms a blockage in the conduit.

By using the sensing means, the speed of snow disposal can be varied to fit the particular sewage system which is used for snow disposal, at any time during the night or day. Thus, where the load bearing capacity of the liquid is limited due to low temperatures, predetermined rotation of the motors will permit discharge only, of the quantity of snow that can be absorbed.

In accordance with another embodiment of the present invention there is provided a snow disposal system for disposal of snow into a sewer system comprising: a plurality of grinding and feeding mans for advancing a load of snow received by the grinding and feeding means, in a first direction; advancing means for feeding ground snow from the grinding and feeding mean in a second direction to means for projecting snow; and means of projecting snow advanced form the advancing means into a sewer system having a liquid flow adapted to receive and transport the snow away from a disposal site.

In a particularly preferred embodiment, the snow disposal system also includes means operatively associated therewith for receiving a charge of snow when a sewer system cannot receive the charge of snow directly, the means operatively associated with the disposal system comprising a retention area having mans for heating around up snow to melt the same, and discharge means for conducting liquid effluent from the retention area to the sewer system.

According to another aspect of this invention there is also provided a method of snow disposal or flow control comprising: providing snow receiving means adapted to receive a charge of snow to be deposed of; grinding the charge of snow into a generally particular from; advancing the ground snow in said disposal direction; projecting snow discharged by the grinding step in a path spaced from the grinding step; disposing of the snow in a disposal means for receiving projected snow downstream in a direction from which the snow is projected, the snow being disposed of in disposal means including a conduit having a liquid flow adapted to receive and transport particulate snow away from the disposal site.

In a preferred method, the snow is initially charged into a bin like structure which is adapted to receive snow to be disposed of. Further, there may be provided means for preventing snow charged to the structure from adhering to the structure; to this end the method may include the step of heating one or more parts of the structure or in an alternative embodiment, the method may include the step of coating the structure with a coating adapted to prevent the snow from sticking thereto.

In preferred method embodiments, there is also included the step of sensing the load carrying capacity of the liquid into which the snow is to be discharged in order to determine the load carrying capacity of the liquid and then altering the feeding step and grinding step to coordinate the same with the load bearing capacity of the liquid so as to avoid overloading the liquid capacity to absorb the snow.

BRIEF DESCRIPTION OF THE DRAWINGS

Having thus generally described the invention, reference will now be made to the accompanying drawings, illustrating preferred embodiments and in which.

DETAILED DESCRIPTION OF PREFERRED EMBODIMENTS

Figure 1:
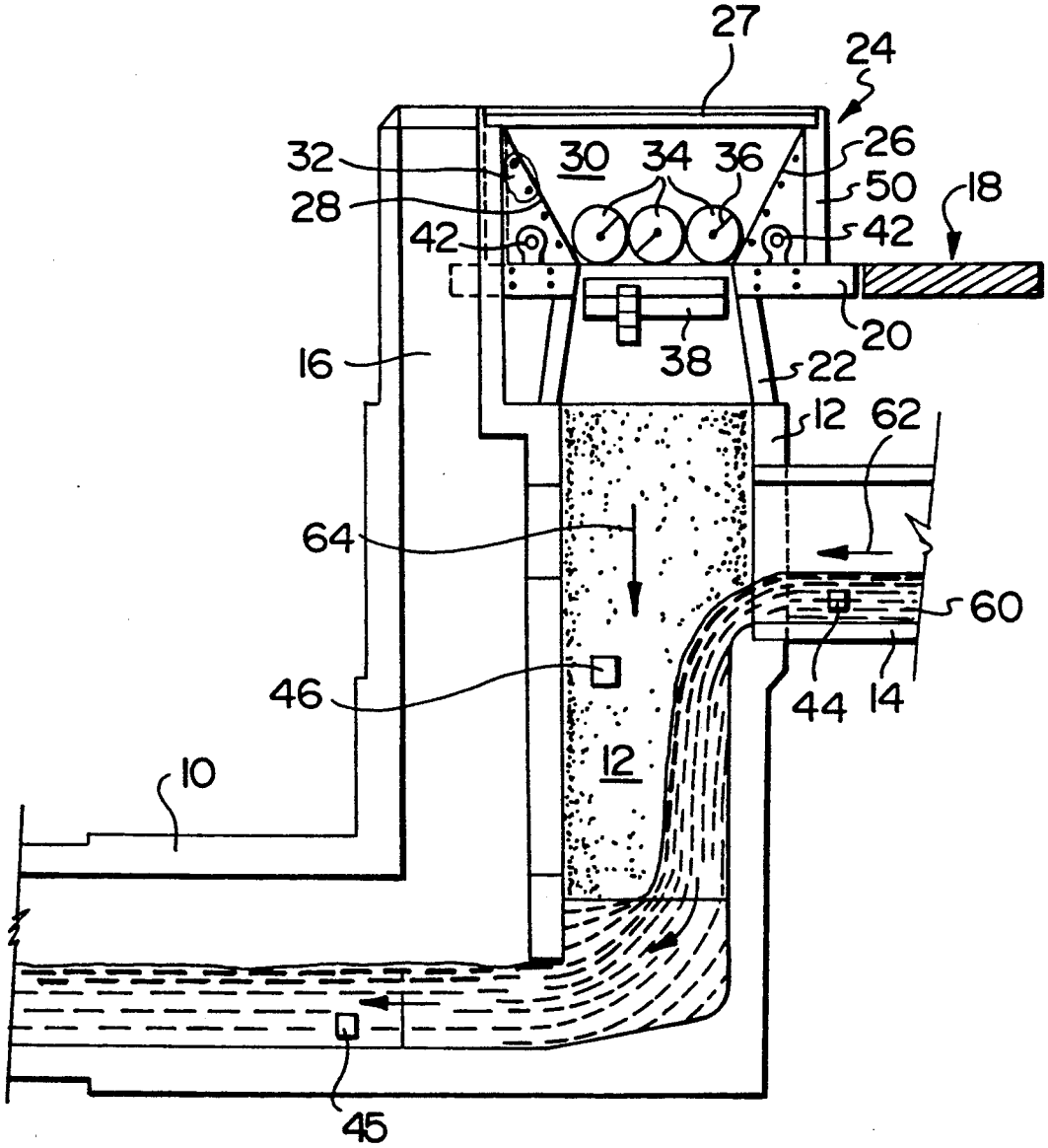
FIG. 1 is a vertical elevational view, partially in section, showing a typical sewer system utilizing the device of one embodiment of the present invention.

Referring now to FIG. 1, an example of a sewer system as may be encountered in many cities includes a main or primary conduit indicated by reference numeral 10, which may lead to a collector system for the overall sewer system or which may be a side branch conduit feeding into a primary conduit.

The underground conduit 10 is normally connected to vertically oriented conduits 12 which are of a generally cylindrical configuration; there may also be included intermediate conduits 14 feeding into the vertical conduit where liquid sources are then discharged into the conduit 12 and thence to conduit 10.

In some cases, the sewer system will also include access or vent conduits such as conduit 16 associated with another smaller conduit 14.

Conduit 12 terminates, at a lower surface level (beneath ground level) indicated by reference numeral 18 generally in a rimmed circular or rectangular opening, which includes normally a steel or metal rim 20 connecting a manhole opening to the conduit 12 via a tapering collar 22. As indicated previously, such openings normally are between two to four feet in diameter.

The system of this invention may be in the form of a mobile snow grinding and projection system indicated generally by reference numeral 24 and which includes a tapering bin like structure 26 having walls extending downwardly into a narrower throat portion 28. The walls 30 of the bin like structure may include heating means 32 in the form of electrical, gas or fuel fired burners or heaters, or the like, which said in preventing the snow from sticking or adhering to the walls 30 of the bin like structure 26.

If desired, a grate may be provided over the bin 26, which grate is indicated by reference numeral 27, to prevent foreign objects from entering the bin. This grate can be in the form of a suitable mesh or screen.

In the embodiment illustrated, located within the bin like structure 26 are grinding means in the form of rotating rollers 34 which carry blades 36 so that the action of the blades 36, upon a load or charge of snow placed into the bin like structure 26, is such that the snow is ground into a particulate form.

Operating in conjunction with the grinding means is an impeller assembly indicated generally by reference numeral 38 which is driven by a motor 42 (described hereinafter). The impeller assembly 38 may be a conventional assembly capable of receiving particulate snow and projecting the same into a downwardly extending trajectory into the conduit 12.

Drive means in the form of one or more motors 42 are provided for effecting rotation of the grinding means and the impeller assembly 38. Such motors 42 may be variable speed motors or constant speed motors connected to a variable speed reducer, and control means in the form of a suitable conventional switch will determine the speed of rotation of the motors. Operating in conjunction with the switch for controlling the speed of the motor are sensors 44, 45 and 46; the first of which (44) is placed within the liquid in the sewer system; and sensor 46 is placed generally in the path of the ground snow. Sensor 44 is adapted to determine the load carrying capacity of the liquid in terms of its ability to absorb and carry snow placed in the liquid. Sensor 44 is preferably located upstream of the system; in addition, a sensor 45 may be included downstream of the entry point of the snow into the liquid flow. In addition, sensor 44 can function to determine the temperature and thus the load carrying capacities of the liquid flow in the sewer system and conversely, the amount of snow that may be injected into the sewer system without danger of blockage by lowering the fluid flow temperature to a point at which blockage would occur. As will be understood, the temperature of the liquid flow through the sewer system, depending on the city and conditions involved, may range from 34° to 45° or more and consequently, there is a large variation in the snow absorption capability of such liquid flow. By taking maximum advantage of the heating capabilities of the fluid flow in the sewer system and with the sensor 44, the present invention can permit a maximum of snow to be dumped in a sewer system to utilize the maximum BTU's available.

Sensor 46 is adapted to determine blockage of the conduit 12 in feeding the snow into the sewer system. Thus, both sensors may be connected to the switch controlling the motors so that upon a blockage occurring, the motors will cease feeding snow to the impeller means 38, or on the other hand, when the load carrying capacity of the liquid in the sewer system reaches a maximum, the amount of snow being fed to the sewer system can be reduced. Suitable conventional sensors 44, 45 and 46 can be used; in practice, sensors 44, 45 and 46 may be connected to a control panel which in turn, is coupled to a control switch for controlling the speed of rotation of motors 42. Both sensors 44 and 46 may be placed in the sewer system either in a permanent or temporary manner, depending on whether the same manhole opening is to be used year after year.

In the example shown, the apparatus of this invention may be suspended or mounted on suitable frame members 50 which are adapted to surround the manhole opening. Such frame members 50 can be a separate frame structure and need not be part of the overall assembly.

In the system illustrated in FIG. 1, where a side sewer conduit 14 enters into a vertical conduit 12, liquid 60 generally flows in the direction of arrow 62 and falls to the bottom of conduit 12 where it enters into the primary conduit 10 By forcefully projecting snow using the system of this invention downwardly in the direction of arrow 64, the projected snow is mixed with and absorbed by the liquid in the sewer system, whereafter it is discharged into the primary conduit 10.

Figure 2:
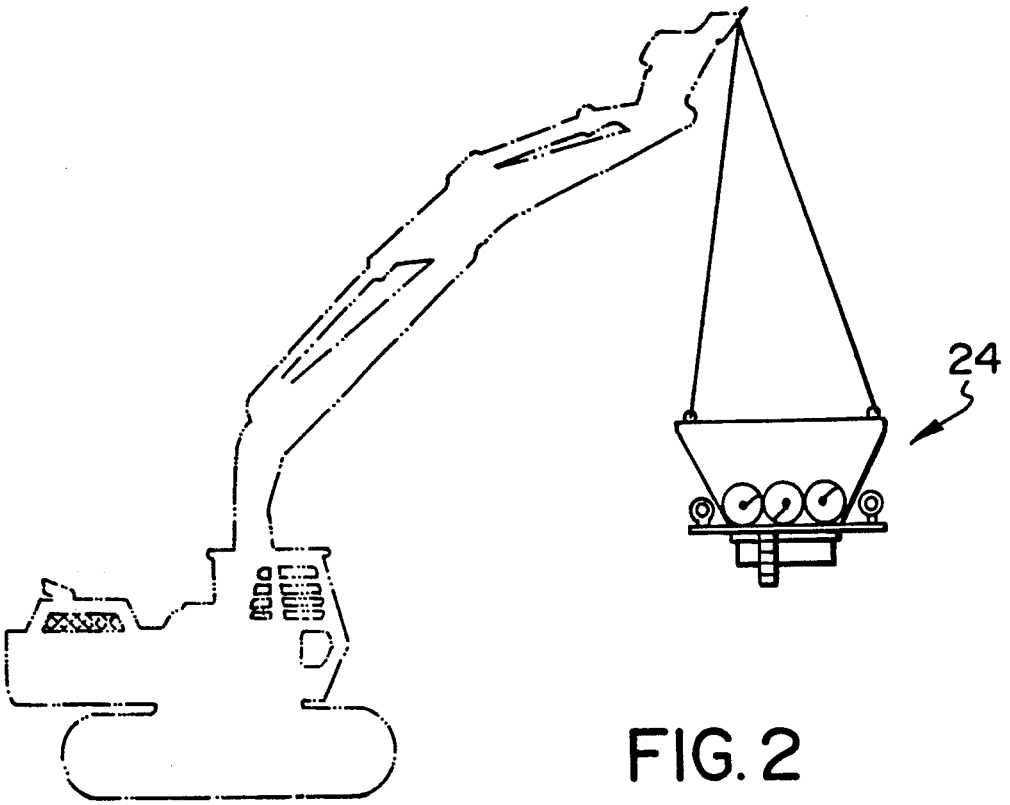
FIG. 2 is a diagrammatic representation showing transporting and placement of the system of the present invention.

Referring to FIG. 2, since snow disposal operations are only intermittently required, the system of the present invention can be transported by suitable means, e.g. a crane, to a site where an appropriately selected manhole and associated sewer system is to be used. Upon termination of the snow disposal operations, the system can then be transported to a storage place. Of course, if desired, the system may be left in place during selected months or all year.

In one embodiment, the arrangement shown in FIG. 2 may be mounted or fixedly secured to a trailer or other movable means of transportation so that the unit can be transported to different sites where and as required during the course of its operations. Typically, any suitable trailer means may be employed for this purpose.

Figure 2A:
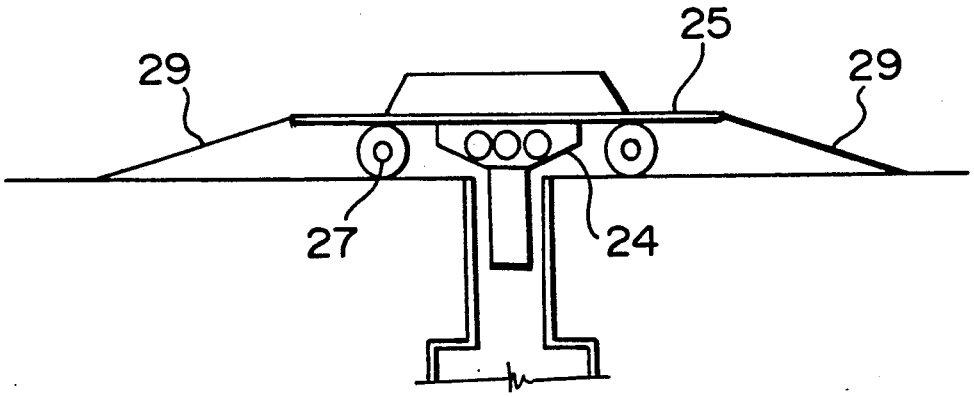
FIG. 2A is a diagrammatic representation showing an alternate embodiment of this invention wherein the system is mounted on a trailer for movement to different sites of operation.

Referring now to FIG. 2A, the system includes a unit indicated generally by reference numeral 24, as previously described, which is mounted beneath a platform 25 which in turn includes a trailer wheel system 27 of conventional construction. Associated with the trailer, during operation, are one or more ramps 29 which a dump truck may back onto in order to discharge a load of snow into the hopper of the system 24. Also, a further modification would be to provide the source of power for operation of the system using any power source which otherwise is employed to move the trailer system, e.g. the truck motor. Then, the system becomes a totally self-contained system which can result in significant economy.

Figure 3:
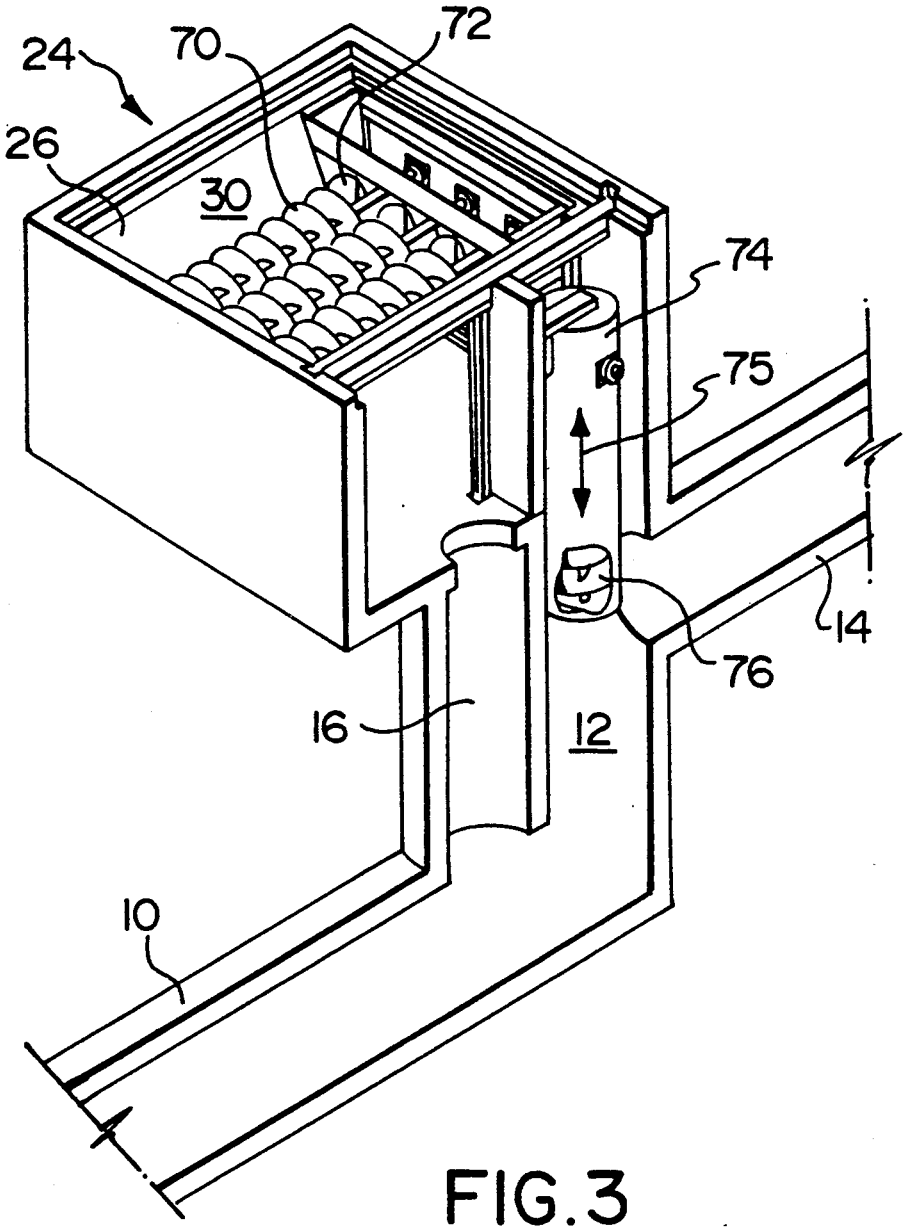
FIG. 3 is a perspective view, partially in section, showing a typical sewer system utilizing the device according to another embodiment of the present invention.
Figure 4:
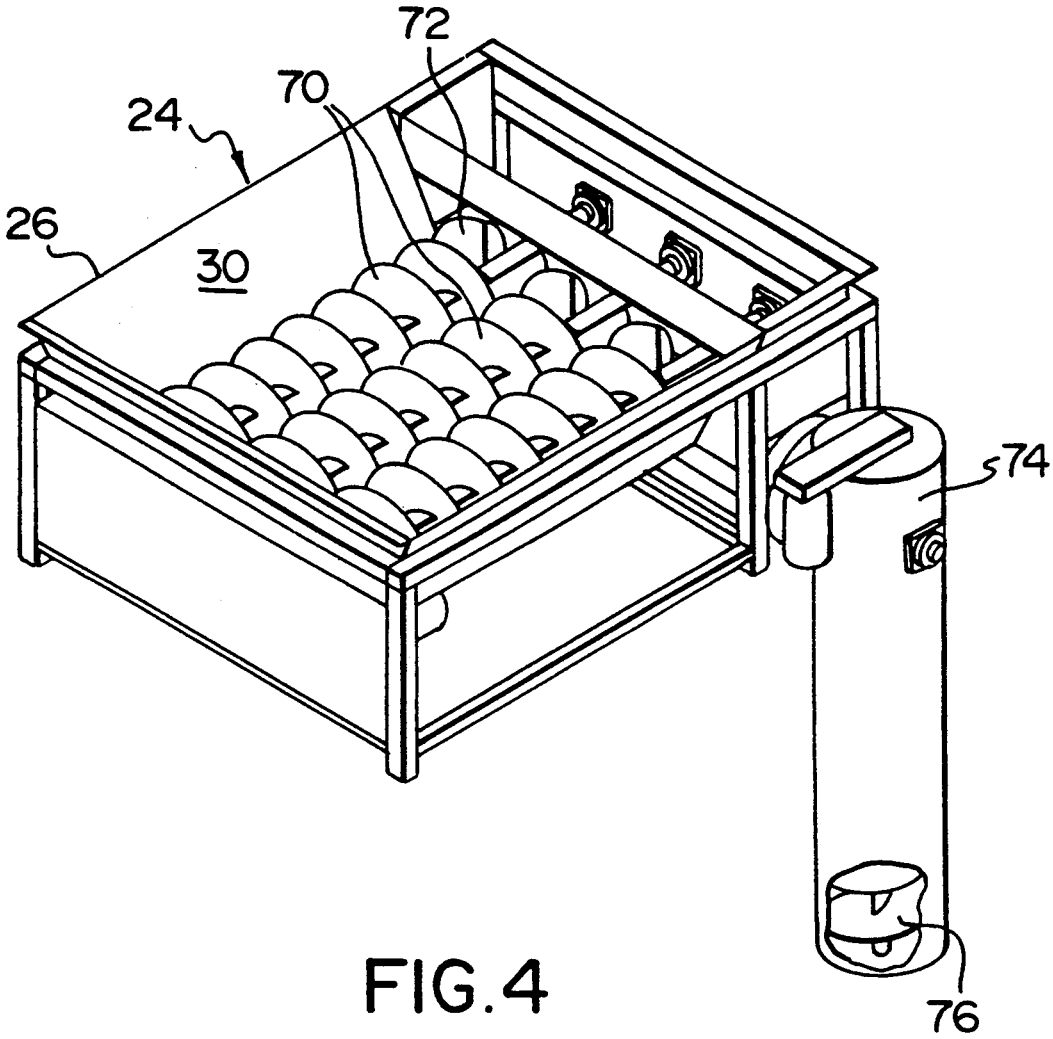
FIG. 4 is a perspective view of the device of the present invention illustrated in FIG. 3.
Figure 5:
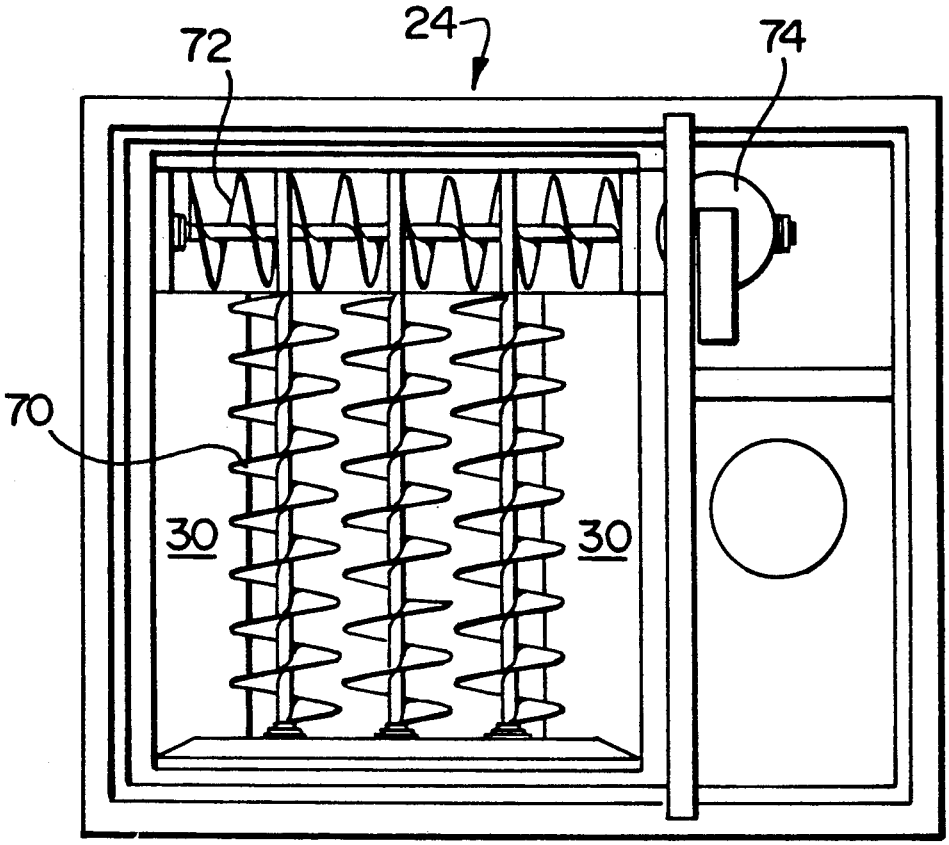
FIG. 5 is a top plan view of the device of the present invention illustrated in FIG. 4.

Referring now to FIGS. 3, 4 and 5, these figures illustrate another embodiment of the present invention.

In FIG. 3, which is similar to FIG. 1 with like reference numerals designating like parts, the mobile snow grinding and projection system 24 includes a tapering bin like structure 26.

As in the embodiment of FIG. 1, the walls 30 of the bin like structure may include heating means and a grate (not shown) may be provided over the bin.

Located within the bin are grinding means in the form of a plurality of rotating helical blades 70 (augers)

which aid in grinding the snow and feeding the snow to feeder 72, also in the form of a rotating helical blade. Feeder 72 is located at one end of helical blades 70 at right angles thereto and feeds the snow to a vertically oriented chute 74. This chute 74 may be of an adjustable type as indicated by the arrow 75 (FIG. 3). Chute 74 includes therein a further rotating helical blade 76 which further grinds the snow and projects the same in a downward trajectory into the conduit 12.

It will be appreciated that the feeders 72, 74 and 76 may also be in the form of a piston type arrangement which pushes the snow towards chute 74. Similar drive means and sensors to those described with reference to FIG. 1 may be employed in this embodiment.

In the embodiment of FIGS. 3 to 5, the chute 74 and the rotating helical blade 76 therein are removably mounted to the assembly. Thus, in case of malfunction or breakdown of the helical blade 76, the same can be removed to permit repair thereof. In the absence of helical blade 76 in the chute 74, the snow is simply projected through the chute and into the conduit 12. Thus, although the helical blade 76 aids in the specific projection and direction in a targeted manner of the snow, it is not necessary and can be removed if desired.

Instead of the arrangement illustrated, it will be appreciated that other discharging means can be utilized, such as an impeller, turbine, etc. The purpose of this discharging means is such that it projects, under velocity and in a controlled linear confinement manner, the ground snow into the conduit 12 so that build-up of snow particles is reduced or prevented thereby eliminating or reducing the risk of clogging the conduit 12.

The rotating helical blades 70 are preferably mounted using a gear-arrangement which will be capable of absorbing torque forces without breaking. To this end, the blades 70 and their shafts may be connected through a gear system which may disengage after a given torque has been reached or, other suitable conventional gear arrangements using "jumping gears" can be employed for this purpose. In practice, if the snow dumped into the bin contains other material such as bricks or other hard objects (such as could be encountered when a front end loader is employed to gather snow), the gears will jump and if desired an automatic stop system can be employed to prevent any damage to the unit. In addition, an operator may also reverse the system (either manually or automatically) to said in the removal of undesired debris from the system. Still further, by employing a "jumping gear" arrangement, the rotating helical blades 70 will not rotate, thus preventing damage to the same. It is also contemplated, with the system of the present invention that an operator may simply turn off the motor and remove the undesired object from the bin; once this is accomplished the motor can be started again and thus the helical blades 70 will commence rotating. As will be appreciated the use of such jumping gears protects the device form serious damage.

As described above with respect to FIG. 2A, the arrangements of FIGS. 3 to 5 can also be moved from station to station as desired by way of wheels, ramps (not shown), etc. the arrangement of e.g. FIGS. 3 to 5 may also be permanently installed in various types of sewer systems so that storage during non-winter months can be conveniently effected without removal of the equipment form the site of its use.

Figure 6:
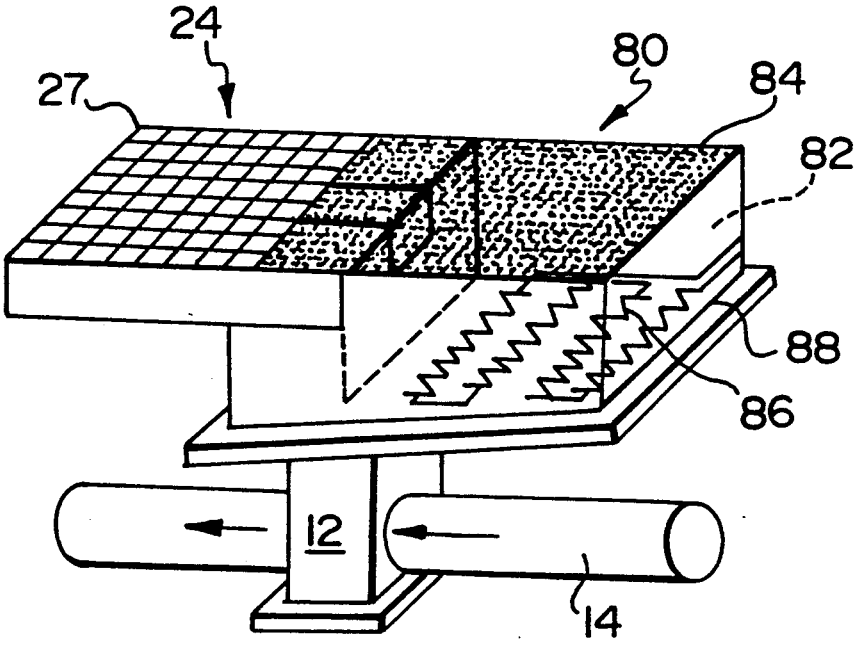
FIG. 6 is a perspective view, showing a typical sewer system utilizing the device according to yet another embodiment of the present invention.

Referring now to FIGS. 6, there is illustrated a further embodiment of the present invention. Like reference numeral to those used in the previous figures designate like parts.

FIG. 6, is very similar to the arrangement illustrated in FIGS. 3 to 5, but further includes an arrangement operatively associated wherewith for receiving a charge of snow when a user system may not for a period of time receive the charge of snow directly. This, on occasion, may happen due to the low BTU capacity of he liquid flow of the sewer system and until the carrying capacity is increased, it may be necessary to re-route the excess snow towards a snow melter as described herein and indicated generally by reference numeral 80. The arrangement 80 includes a retention area 82 which may also include a cover 84 covering the top thereof. The retention area 82 includes heating means 86 for heating and melting ground up snow deposited into the retention area 82. As noted above the retention are is operatively associated with the disposal system described in the previous figures and thus the melted snow in the retention area 82 can be discharged into the sewer system.

To this end, the arrangement used for feeding the snow as outlined with respect to FIGS. 1 to 5 can be modified to include switch or like means for rendering the rotating helical blade 72 inoperative so that the plurality of rotating blades 70 will thus push the snow, or any desired portion thereof, into the retention are 82. If desired, there may also be provided mean such as a closure door which can be remotely operated for preventing snow gaining access to the chute 74.

Once in the retention area 82, the particulate snow is then melted b7 the heaters 86 (which may be any suitable heating arrangement) and the liquid flow from melted snow can then be passed directly into the conduit 12 by virtue of appropriate channels or conduits extending through/from the .loor 88 the conduit 12. In this manner, since only liquid is being introduced into the sewer system, there is little or not increase in danger of obstructing the sewer system with blockages due to the additional liquid being introduced.

Having described preferred embodiments, it will be understood that various modifications can be made to the above embodiments without departing from the spirit or scope o the invention.

I claim:

1. A snow disposal and flow control system comprising:

a mobile snow receiving chamber removably mounted above a conduit, said chamber adapted to receive a charge of snow to be disposed of;

first advancing means for advancing said charge of snow in a disposal direction in said chamber;

propeller means for effecting a vertical projection from said chamber of snow discharged by said first advancing means, in a downwardly extending path removed from said first advancing means;

disposal means for receiving projected snow from said chamber located downstream in a direction in which said snow is projected by said last mentioned means, said disposal means including said conduit beneath said propeller means and having a liquid flow adapted to receive and transport disposed project away from the disposal site.

2. A system as defined in claim 1, wherein said snow receiving chamber comprises a bin like structure adapted to receive snow to be deposed of, wherein snow may be charged to said bin like structure for feeding to said fist advancing means, said advancing means including means for grinding said charge of snow into a generally particulate form.

3. A system as defined in claim 2, wherein said bin like structure includes means for preventing snow charged to said structure from adhering to said structure.

4. A system as defined in claim 2, wherein said grinding means includes at least a pair of counter rotating blades, means for driving said counter rotating blades, means for driving said means for effecting said projection of snow, said system including control means adapted to govern the amount of particulate snow fed to said conduit.

5. A system as defined in claim 2, wherein said system includes sensing means for sensing the load carrying capacity of liquid flow through said conduit.

6. A snow disposal system as claimed in claim 1, wherein there is included means for sensing the temperature of said liquid flow upstream of liquid flow in said conduit and downstream of the liquid flow in said conduit from the point at which particulate snow is introduced into said conduit.

7. A method of snow disposal and flow control comprising:

removably mounting a mobile chamber adapted to receive a charge of snow to be disposed of;

advancing said charge of snow in a vertical disposal direction in said chamber;

projecting snow discharged from said chamber to freely ball in a vertical downwardly extending path spaced from said advancing step;

disposing of said snow in a disposal means for receiving projected snow downstream in a direction from which said snow is projected, said now being disposed of in disposal means including a conduit beneath said downwardly extending path having a liquid flow adapted to receive and transport particulate snow away from the disposal site.

8. A method as defined in claim 7, wherein said snow is initially charged into a bin like structure adapted to receive sow to be disposed of, and said method further includes the step of grinding said snow into generally particulate form.

9. A method as defined in claim 8, wherein said grinding step is carried out with at least a pair of counter rotating blades, means for driving said outer rotating blades and including the step of controlling the amount of particulate snow fed to said conduit.

10. A method as define din claim 7, further including the step of sensing the load carrying capacity of liquid flow through said conduit.

11. A method as defined in claim 7, which includes the step of sensing the temperature of said liquid flow prior to the point at which particulate snow is discharged into said conduit to determine the load carrying capacity of said liquid flow to receive said particulate snow, and sensing the load carrying capacity of the liquid in said conduit after said particulate snow has been discharged into said conduit and into said liquid flow.

12. A snow disposal flow control system for removal of snow into a sewer system comprising:

a plurality of feeding means for advancing a load of snow received by said feeding means, in a first direction;

advancing means for feeding ground snow from said feeding means in a second direction to means for projecting snow;

means for projecting snow advanced from said advancing means into a sewer system having a liquid flow adapted to receive and transport said snow away from a disposal site; and means for sensing the temperature of said liquid flow upstream of liquid flow in said conduit and downstream of the liquid flow in said conduit from the point at which particulate snow is introduced into said conduit.

13. A snow disposal system as claimed in claim 12, wherein said feeding means comprises a plurality of rotating helical blades for receiving and transporting snow discharged thereat in a firs direction away from a snow receiving site, said rotating helical blades adapted to grind the snow into generally particulate form.

14. A snow disposal system as claimed in claim 12, wherein said advancing means comprises at least one rotating helical bade in communication with said feeding means and in further communicating with said means for projecting said snow into a sewer system.

15. A snow disposal system as claimed in claim 12, wherein said means for projecting snow received from said advancing means comprises a housing in the form of a chute having an impeller therein.

16. A snow disposal system as claimed in claim 12, wherein said means for projecting said snow is removably mounted in said snow disposal system.

17. A snow disposal system as claimed in claim 12, wherein said snow disposal system further includes means operatively associated therewith for receiving a charge of snow when a sewer system cannot receive said charge of snow directly, said means operatively associated with said disposal system comprising a retention area having means for heating around up snow to melt the same, and discharge means for conducting liquid effluent from said retention area to said sewer system.

18. A snow disposal and flow control system comprising:

snow receiving means adapted to receive a charge of snow to be disposed of;

first advancing means for advancing said charge of snow in a disposal direction;

means for effecting a projection of snow discharge by said first advancing means in a path removed from said first advancing means;

disposal means for receiving projected snow from said means for effecting located downstream in a direction in which said snow is projected by said means for effecting, said disposal means including a conduit having a liquid flow adapted to receive and transport disposed project away from the disposal site; and sensing means for sensing the load carrying capacity of liquid flow through said conduit.

19. A method of snow disposal and flow control comprising:

providing snow receiving means adapted to receive a charge of snow to be deposed of;

advancing said charge of snow in a disposal direction;

projecting snow discharged by said advancing step in a path spaced from said advancing step;

disposing of said snow in a disposal means for receiving projected snow downstream in a direction from which said snow is projected, said snow being disposed of in disposal means including a conduit having a liquid flow adapted to receive and transport particulate snow away from the disposal site; and sensing the load carrying capacity of liquid flow through said conduit.

* * * * *